US008118160B2

(12) United States Patent
Ghini et al.

(10) Patent No.: US 8,118,160 B2
(45) Date of Patent: Feb. 21, 2012

(54) PACKET FOR TOBACCO PRODUCTS

(75) Inventors: Marco Ghini, Bologna (IT); Roberto Polloni, Modigliana (IT); Stefano Negrini, Calderara di Reno (IT)

(73) Assignee: G.D S.p.A. (IT)

( * ) Notice: Subject to any disclaimer, the term of this patent is extended or adjusted under 35 U.S.C. 154(b) by 218 days.

(21) Appl. No.: 11/793,986

(22) PCT Filed: Dec. 19, 2005

(86) PCT No.: PCT/IB2005/003993

§ 371 (c)(1),
(2), (4) Date: Jun. 25, 2007

(87) PCT Pub. No.: WO2006/067621

PCT Pub. Date: Jun. 29, 2006

(65) Prior Publication Data

US 2008/0047852 A1 Feb. 28, 2008

(30) Foreign Application Priority Data

Dec. 23, 2004 (IT) ..... B2004A0808

(51) Int. Cl.
*B65D 85/10* (2006.01)

(52) U.S. Cl. ..... 206/268; 206/264; 206/265; 206/273; 229/87.13

(58) Field of Classification Search ..... 206/259–268, 206/271, 273–276, 256–258; 229/87.12–87.14, 229/160.1

See application file for complete search history.

(56) References Cited

U.S. PATENT DOCUMENTS

| | | | | | |
|---|---|---|---|---|---|
| 437,042 | A | * | 9/1890 | Peck | 229/120.09 |
| 2,074,451 | A | * | 3/1937 | Berberian | 206/256 |
| 2,158,971 | A | * | 5/1939 | Stratton | 206/258 |
| 3,039,671 | A | * | 6/1962 | Chiamardas | 229/120.03 |
| 3,148,768 | A | * | 9/1964 | Gatto | 206/256 |
| 3,226,010 | A | * | 12/1965 | Rogers, Jr. | 229/87.13 |
| 4,294,353 | A | * | 10/1981 | Focke et al. | 206/273 |
| 4,375,260 | A | * | 3/1983 | Focke et al. | 206/264 |
| 4,485,926 | A | * | 12/1984 | Lenzmeier | 229/120.011 |

(Continued)

FOREIGN PATENT DOCUMENTS

KR 10-1993-0009498 10/1993

(Continued)

OTHER PUBLICATIONS

Korean Office Action dated Oct. 12, 2011 from related application.

*Primary Examiner* — J. Gregory Pickett
*Assistant Examiner* — Ernesto Grano
(74) *Attorney, Agent, or Firm* — Timothy J. Klima; Shuttleworth & Ingersoll, PLC

(57) ABSTRACT

A cigarette packet of substantially parallelepiped geometry comprises an outer wrapper (3) divided into two portions (17, 18) connected one to another by a longitudinal hinge (19) extending along one of the two flanks (7, 8), each portion (17, 18) creating a compartment (20, 21) proportioned to accommodate a relative box (22), likewise parallelepiped, which is filled with a limited number of cigarettes (2); the outer wrapper (3) is topped by a lid (10) pivotable on a transverse hinge (16) between a closed position of contact with the top ends of the boxes (22), and an open position in which the boxes (22) are free to swing apart on the longitudinal hinge (19).

17 Claims, 9 Drawing Sheets

U.S. PATENT DOCUMENTS

| | | | | | |
|---|---|---|---|---|---|
| 4,607,748 | A | * | 8/1986 | Focke | 206/254 |
| 4,784,261 | A | * | 11/1988 | Kutchin | 206/256 |
| 5,277,304 | A | * | 1/1994 | Brizzi et al. | 206/256 |
| 5,344,008 | A | * | 9/1994 | DeBlasio et al. | 206/256 |
| 5,435,440 | A | | 7/1995 | Focke et al. | |
| 5,467,872 | A | * | 11/1995 | Minarelli et al. | 206/256 |
| 5,647,190 | A | * | 7/1997 | Minarelli et al. | 53/446 |
| 6,223,895 | B1 | * | 5/2001 | Bowen et al. | 206/236 |
| D492,814 | S | * | 7/2004 | Bray et al. | D27/189 |
| D492,815 | S | * | 7/2004 | Bray et al. | D27/189 |
| D495,824 | S | * | 9/2004 | Bray et al. | D27/189 |
| 6,941,728 | B1 | * | 9/2005 | Bray et al. | 53/449 |

FOREIGN PATENT DOCUMENTS

| | | | |
|---|---|---|---|
| KR | 20-0243183 | | 10/2011 |
| WO | 02/076247 | | 10/2002 |
| WO | WO 02/076247 | A1 | 10/2002 |
| WO | WO 2004/080844 | A1 | 9/2004 |
| WO | WO 2005/054056 | A1 | 6/2005 |

* cited by examiner

PACKET FOR TOBACCO PRODUCTS

This application is the national phase of international application PCT/IB2005/003993 filed 19 Dec. 2005 which designated the U.S. and that international application was published under PCT Article 21(2) in English. This application claims priority to Italian Patent application number BO2004A 000808, filed 23 Dec. 2004, which is incorporated by reference herein.

TECHNICAL FIELD

The present invention relates to a packet for tobacco products.

In particular, the invention relates to a packet of cigarettes.

BACKGROUND ART

The prior art embraces cigarette packets of rigid, hinge-lid type comprising an outer wrapper embodied as a box, and a lid attached hingedly to the box; also, a stiffening frame secured in part to the box and serving to keep the lid correctly and stably in position when the box is closed.

The box contains a group of cigarettes, enveloped by an inner wrapper of metal foil paper.

One of the drawbacks associated with such a packet is that, after opening the lid and removing part of the inner wrapper to gain access to the contents, the entire group of cigarettes remains exposed to the surrounding air, hence inadequately protected, until the last one is taken from the packet, by which time there will have been a loss of aroma, of moisture, and consequently of organoleptic properties.

A further drawback consists in the fact that, since the group is formed by a plurality of cigarettes arranged in layers, once a few single cigarettes have been removed, the remainder tend to detach one from another and shift internally of the box, with the result that tobacco is shed from their respective ends.

The object of the present invention is to overcome the drawbacks mentioned above.

DISCLOSURE OF THE INVENTION

The stated object is realized according to the present invention in packet for tobacco products as recited in claim 1 appended, or in any subsequent claim directly or indirectly dependent on claim 1.

The invention will now be described in detail, by way of example, with the aid of the accompanying drawings, in which.

Figure 1:
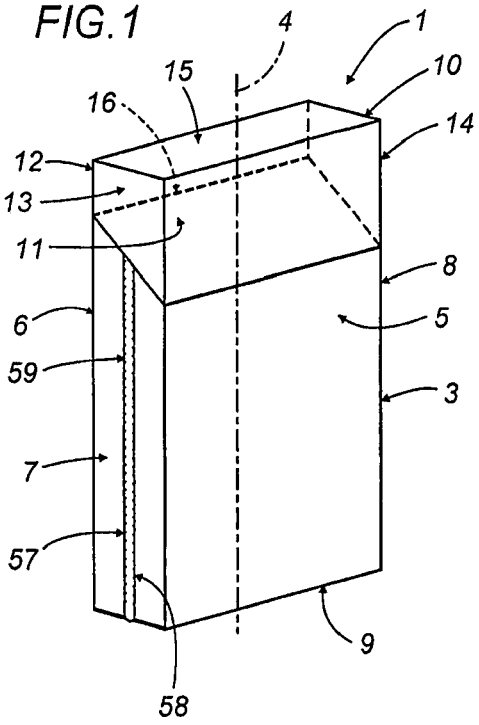
FIGS. 1, 2 and 3 are perspective views showing a first embodiment of the packet according to the present invention, illustrated in three different configurations.

In FIGS. 1 to 12 of the drawings, numeral 1 denotes a packet, in its entirety, for tobacco products such as cigarettes

2. The packets 1 shown are rigid, with a hinged lid, comprising an outer wrapper 3 of substantially parallelepiped geometry referable to a longitudinal axis 4; the wrapper 3 presents two larger side walls 5 and 6, respectively front and rear (as viewed in the drawings), two smaller sides or flanks 7 and 8 extending at right angles to the larger side walls and parallel to the axis 4, and a bottom end wall 9 set transversely to the axis 4.

The outer wrapper 3 further comprises a lid 10 having a front wall 11, a rear wall 12, two flanks 13 and 14 and a top end wall 15. The lid 10 is attached to the rear wall 6 of the wrapper 3 along a hinge line 16 extending transversely to the axis 4, and capable of movement between a closed position (see FIGS. 1, 5 and 9) and an open position (FIGS. 2, 3, 4, 6, 7, 8 and 10) of the outer wrapper 3.

Figure 2:
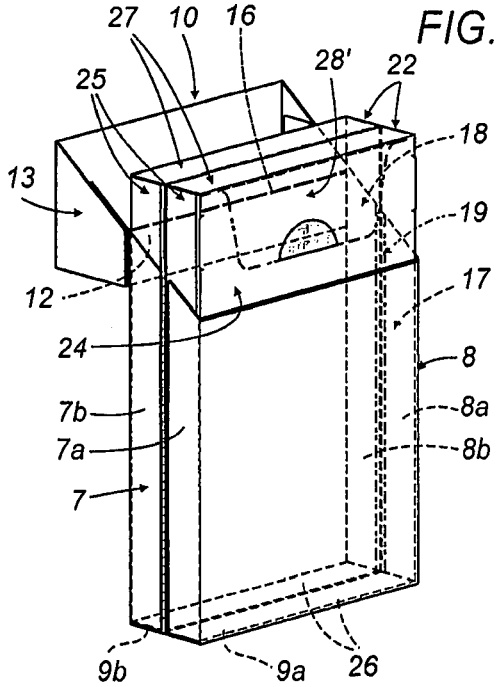
Figure 3:
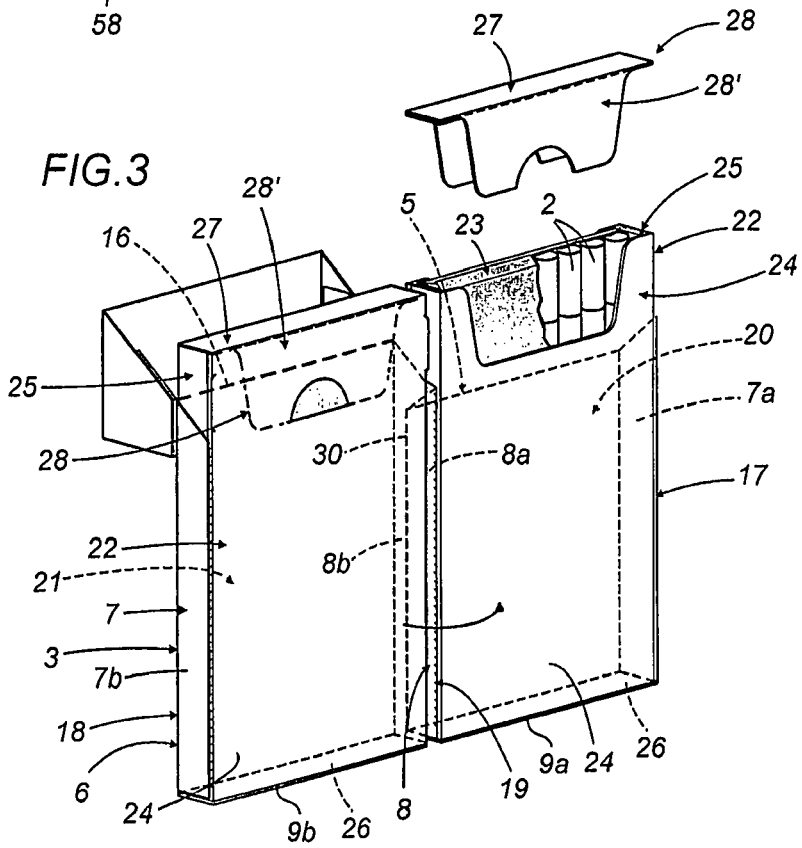

As discernible from FIGS. 1, 2 and 3, the outer wrapper 3 is composed of two distinct portions 17 and 18, with the flank denoted 8 functioning as a connecting element between the two, and presents a crease line 19 along which the aforementioned portions 17 and 18 are hinged longitudinally and rotatable thus one relative to another between a closed position, illustrated in FIG. 2, and an open position illustrated in FIG. 3.

The two portions 17 and 18 serve to create two respective compartments, a first denoted 20 and a second denoted 21, proportioned to house respective parallelepiped boxes 22 identical one to another, each containing a single row of cigarettes 2 disposed with axes parallel to the axis 4 of the packet and enveloped by an inner wrapper 23 of metal foil paper.

More exactly, the first compartment 20 is delimited by the front wall 5, in combination with a first portion 8*a* of the flank 8 lying between the hinge 19 and the front wall 5, a portion 9*a* of the bottom 9, and a portion 7*a* of the remaining flank 7. In like manner, the second compartment 21 is delimited by the rear wall 6 in combination with a second portion 8*b* of the flank 8 lying between the hinge 19 and the rear wall 6, a portion 9*b* of the bottom 9, and a portion 7*b* of the remaining flank 7.

Figure 17:
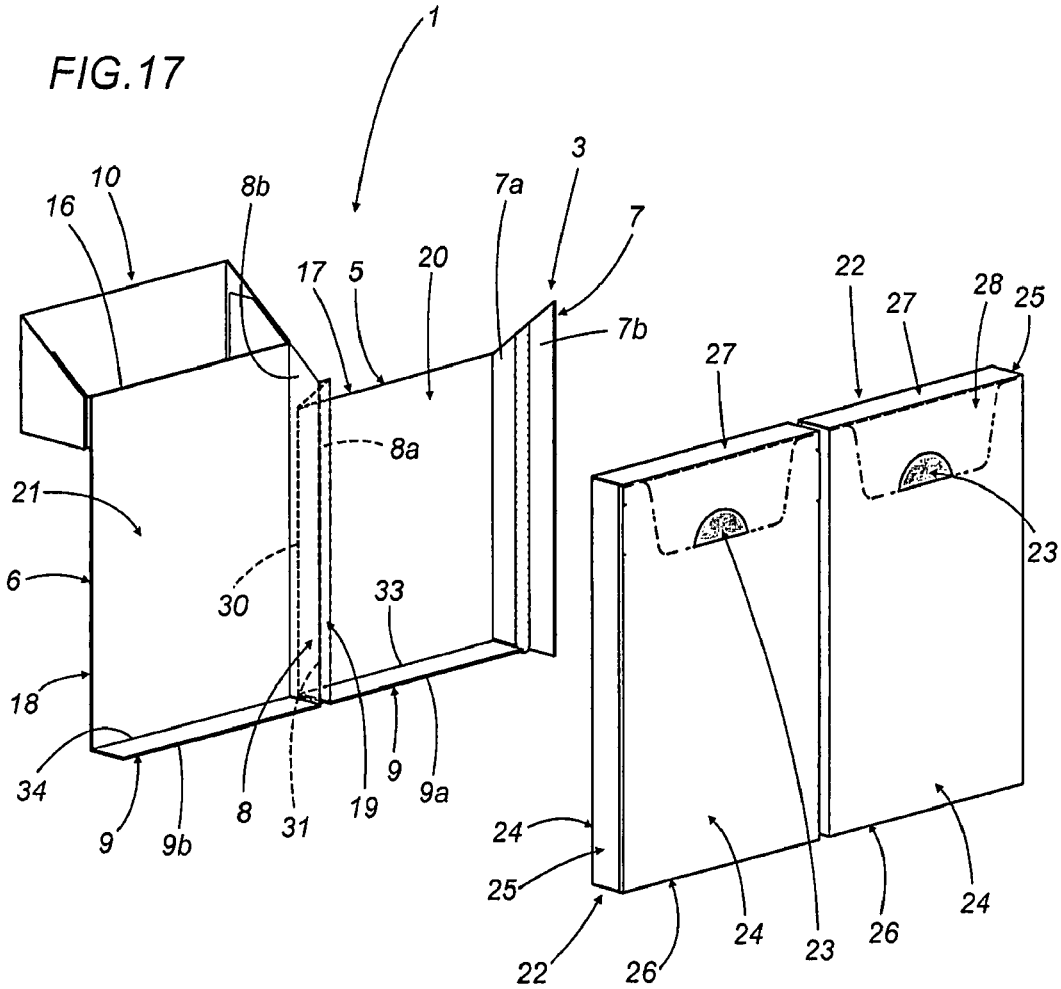
FIG. 17 is a perspective and exploded view of the packet illustrated in FIG. 1.

Referring to FIGS. 2 and 17, each box 22 presents a longitudinal dimension substantially equal to that of the outer wrapper 3 and a transverse dimension or depth substantially equal to the half the width of the flanks 7 and 8, and is delimited by two larger walls 24, two smaller walls or flanks 25, a bottom 26 and a top 27.

Internally of the first compartment 20, one box 22 is breasted in contact with the front wall 5 of the wrapper 3 by way of one larger wall 24, also with the two relative portions 7*a* and 8*a* of the flanks 7 and 8 by way of its own two flanks 25, and with the relative portion 9*a* of the bottom 9 by way of its own bottom end 26.

Internally of the second compartment 20, a further box 22 is breasted in contact with the rear wall 6 of the wrapper 3 by way of one larger wall 24, also with the two relative portions 7*b* and 8*b* of the flanks 7 and 8 by way of its own two flanks 25, and with the relative portion 9*b* of the bottom 9 by way of its own bottom end 26.

The two boxes 22 are fixed to the corresponding compartments 20 and 21 with a layer of adhesive, and, as indicated in FIGS. 1 and 2, breasted in contact one with another by way of one larger wall 24; in addition, the top ends of the boxes 22 incorporate detachable portions or closure elements 28 and project beyond the edges of the side walls 5, 6, 7 and 8 of the outer wrapper 3, substantially to the point of making contact with the top 15 of the lid 10 (FIG. 1).

When the lid 10 is open, the two boxes 22 can be rotated on the aforementioned longitudinal hinge 19 and opened out in the manner of a book. By removing one of the detachable portions 28, which includes the top 27 and at least one flap 28', the inside of the relative box 22 can be exposed and the cigarettes 2 extracted.

Figure 13:
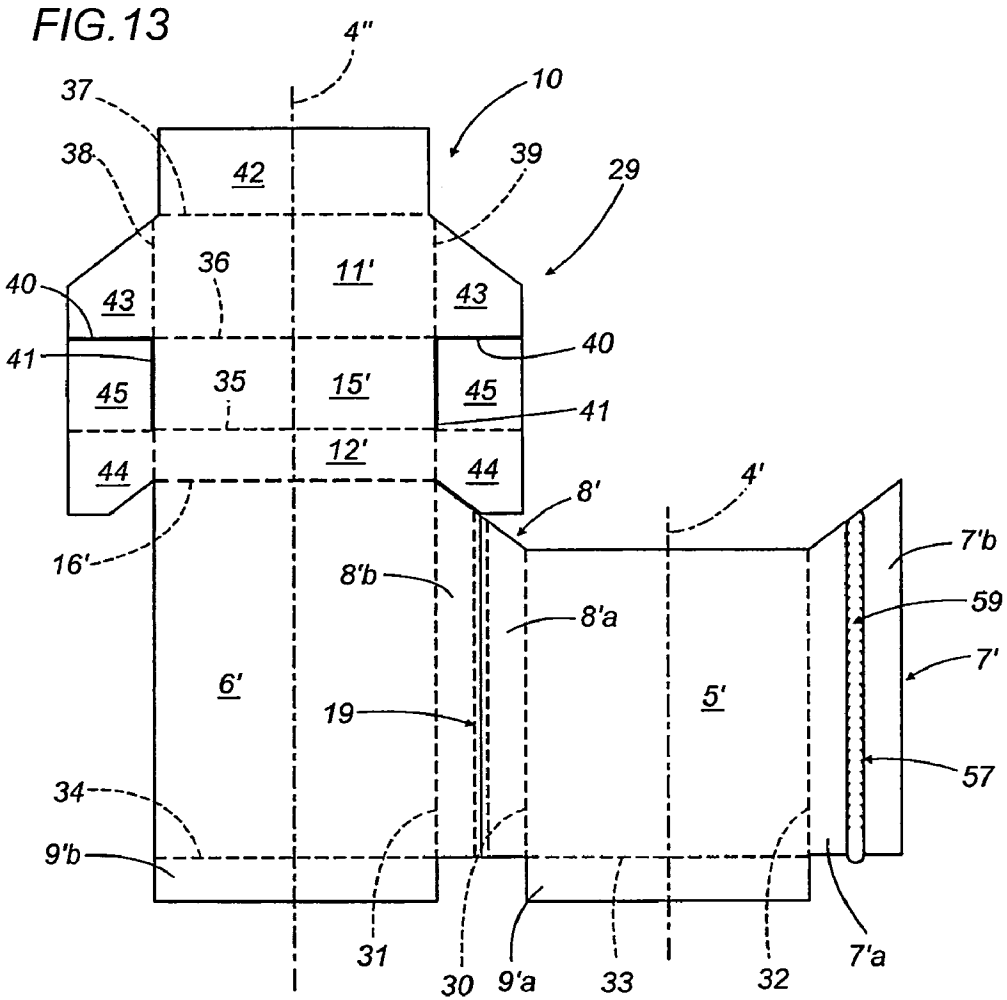

With reference to FIG. 13, the outer wrapper 3 is fashioned by effecting a succession of folds in a flat diecut blank 29 of packaging material.

Where possible, the parts making up the blank 29 are indicated in the course of the description using the same numbers, primed, as those used to identify the corresponding parts of the outer wrapper 3.

The flat blank 29 comprises a first panel 5' and a second panel 6', both substantially rectangular, referable to parallel longitudinal axes 4' and 4" and coinciding with the aforementioned front and rear walls 5 and 6 of the wrapper 3, also a third panel 8' of right trapezoidal outline interposed between the first and second panels 5' and 6' and joined to these same panels along respective longitudinal crease lines 30 and 31; the panel 8' in question constitutes both the aforementioned connecting element and the first flank 8 of the outer wrapper 3.

The blank 29 further comprises a fourth panel 7' of right trapezoidal outline, positioned symmetrically on the opposite side of the first panel 5' to the third panel 8', joined to the first panel 5' along a respective crease line 32 and coinciding with the second flank 7 of the outer wrapper 3, also two transverse end flaps 9*a*' and 9*b*' associated by way of transverse crease lines 33 and 34 with the first panel 5' and the second panel 6', respectively, and combining to establish the bottom 9 of the outer wrapper 3.

Finally, the blank 29 comprises a fifth panel 10' joined to the second panel 6' along a transverse crease line 16' coinciding with the aforementioned transverse hinge line of the lid 10.

The fifth panel 10' presents three transverse crease lines 35, 36 and 37, two longitudinal crease lines 38 and 39 and two pairs of slit cuts 40 and 41 by which it is divided into a transverse panel 12' coinciding with the rear wall 12 of the lid 10, a transverse panel 15' coinciding with the top 15 of the lid 10, a further panel 11' coinciding with the front wall 11 of the lid 10, and finally a panel 42 that functions as a stiffening layer for the front wall 11. The pairs of slit cuts 40 and 41 serve to separate flaps 43, 44 and 45 associated with the aforementioned panels 11', 12' and 15' on either side and combining to form the flanks 13 of the lid 10.

Lastly, the third panel 8' presents at least one longitudinal crease line 19' coinciding with the longitudinal hinge 19 aforementioned.

Figure 14:
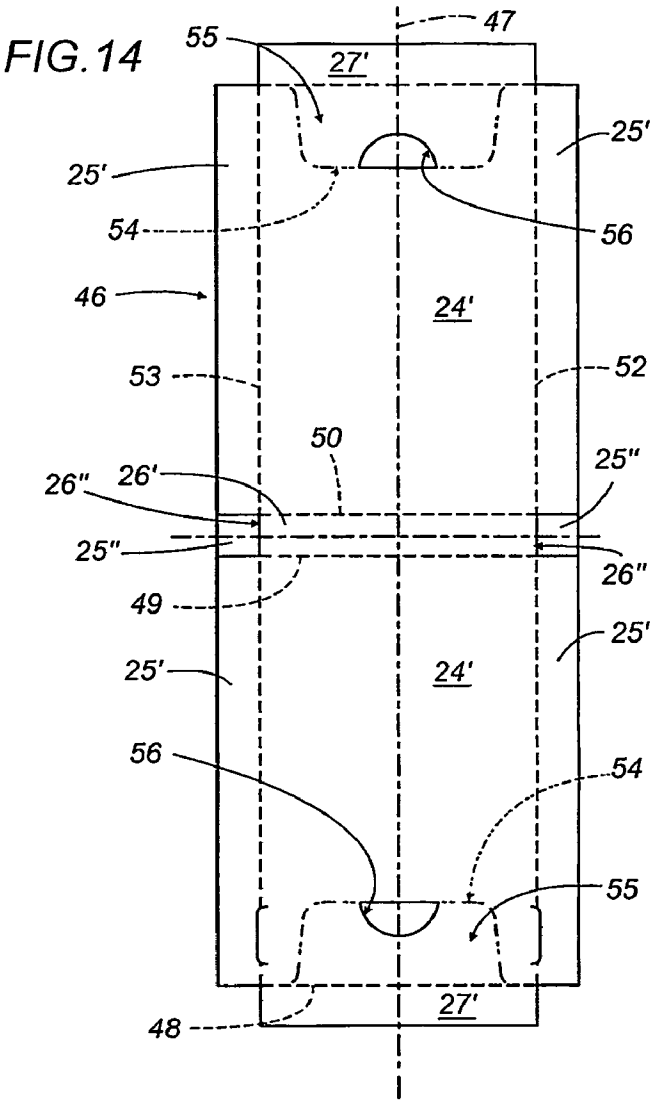
FIGS. 13, 14, 15 and 16 are plan views showing blanks from which the packets of FIGS. 1, 5 and 9 are fashioned.

Referring to FIG. 14, the parallelepiped box 22 is fashioned from a flat diecut blank of packaging material denoted 46.

The parts making up the blank 46 are numbered on the same basis as adopted for the blank 29 described above.

The flat blank 46, which presents a substantially rectangular outline referable to a longitudinal axis denoted 47, is impressed with four transverse crease lines 48, 49, 50 and 51, and two longitudinal crease lines 52 and 53 combining with the four transverse line to create first and second main panels 24' coinciding with the larger walls 24, an intermediate band 26' coinciding with the bottom end 26, two end flaps 27' combining when overlapped to form the top end 27, and pairs of longitudinal flaps denoted 25', associated with each main panel 24' and combining respectively when overlapped to form the smaller walls or flanks 25 of the box 22.

Located at the opposite ends of the intermediate band 26' are pairs of transverse and longitudinal slit cuts 26" forming a letter "L" and serving to create respective closure tongues 25" by which the flanks 25 and the bottom end 26 of the box are secured one to another.

The blank 46 also presents two scored outlines 54 of "U" shape arranged symmetrically on either side of a transverse axis, one at each of the two opposite ends, such as will delimit two detachable portions 55 coinciding with the top end 27 and the aforementioned closure flaps 28'; in effect, the two portions 55 combine one with another and with the end flaps 27' to form the detachable portion 28 of the box 22.

Each portion 55 presents a semicircular opening 56 designed to facilitate the step of gripping and removing the detachable portion 28.

With reference to FIG. 1, the two portions 17 and 18 of the outer wrapper 3 are held together in the closed position by breakable seal means 57 in the form of a longitudinal scored line 58 extending along the second flank 7. More precisely, the seal means 57 consist in two such scored lines creating a removable strip 59.

In an alternative embodiment of the packet, not illustrated, such breakable seal means 57 might take the form of a removable adhesive element.

Figure 4:
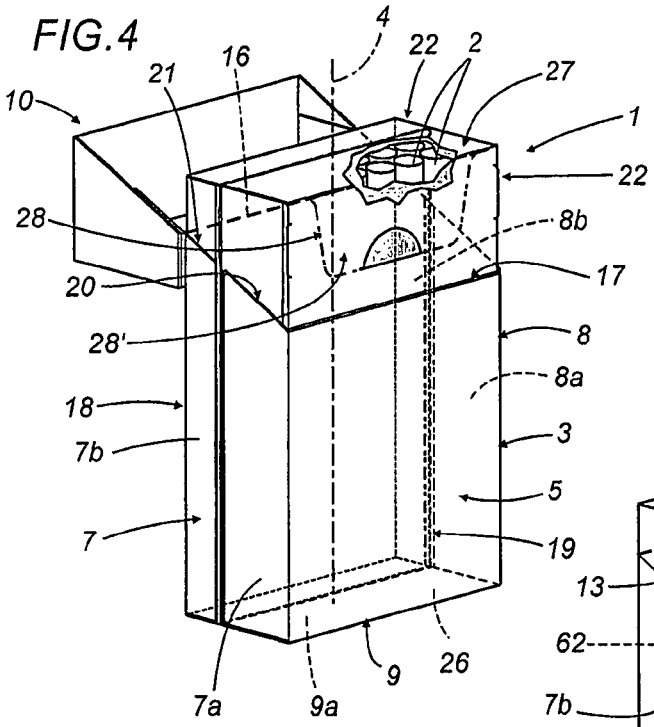
FIG. 4 is a perspective view showing a second embodiment of the packet in FIG. 1.

In the example of FIG. 4, one of the two internal boxes 22, and more exactly the box 22 occupying the first compartment 20, contains a double row of cigarettes 2 and consequently presents a transverse or depth dimension substantially twice that of the adjacent box 22 occupying the second compartment 21.

In the examples of FIGS. 5 to 12, the outer wrapper 3 is divided into three portions, creating compartments to hold three parallelepiped boxes 22.

More exactly, the first compartment 20 and the second compartment 21, associated one with another by way of the connecting element constituting the first flank 8 and occupied each by a respective box 22, are set apart so as to create an intermediate third compartment 60 afforded by a third portion 61 of the outer wrapper 3 and accommodating a third box 22.

Figure 12:
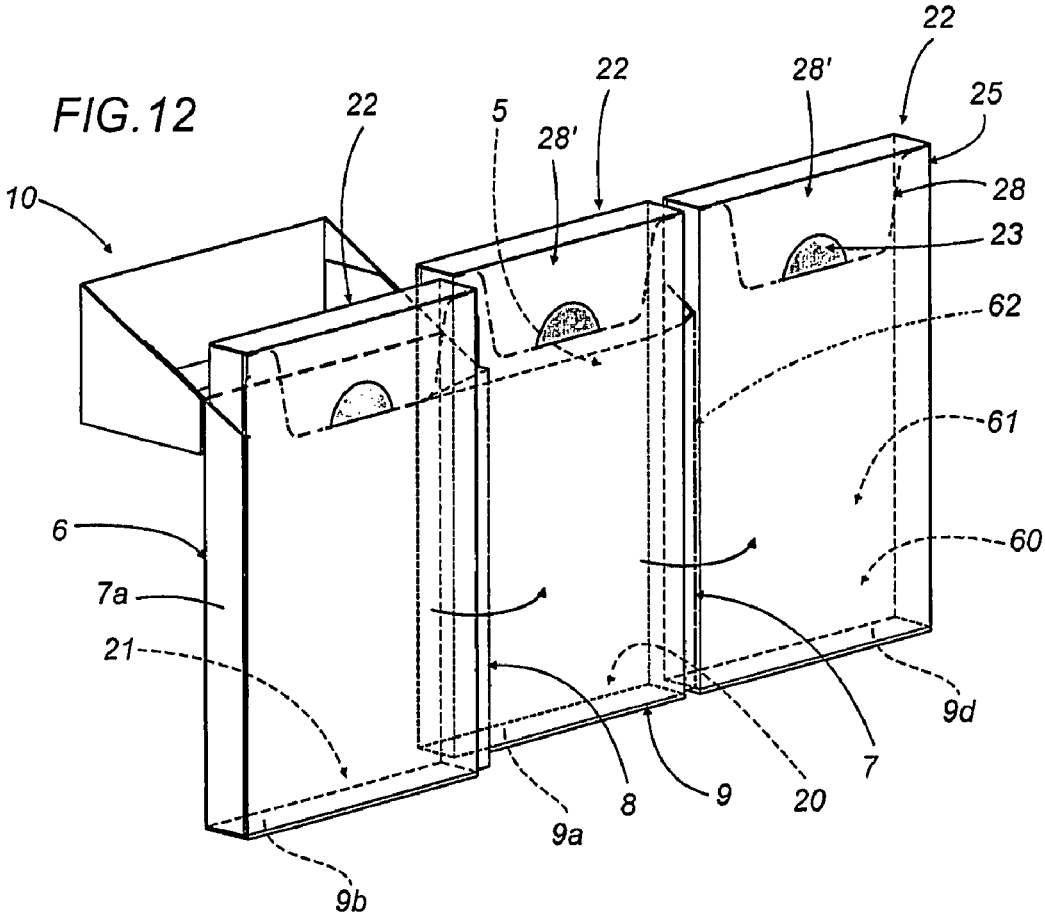

The third compartment 60 is connected in its turn, by way of the second flank 7, which also presents at least one scored line constituting a longitudinal hinge 62, to the second compartment 21 (FIG. 8) or to the first compartment 20 (FIG. 12).

Figure 8:
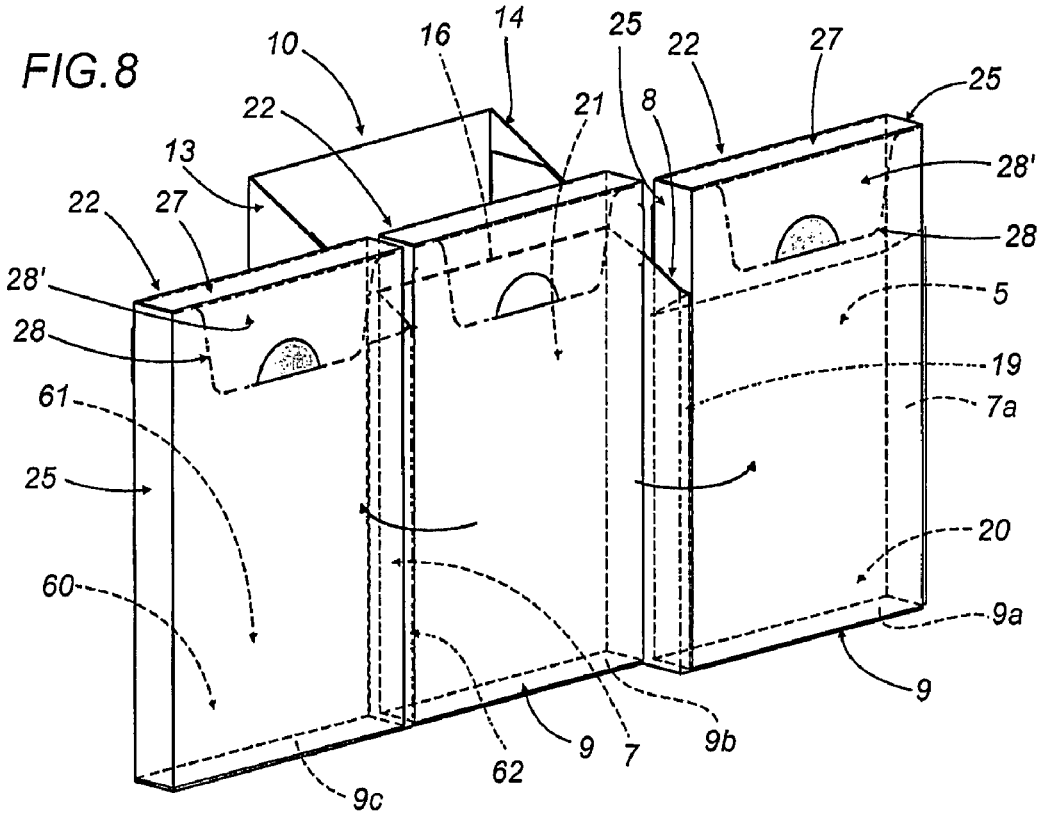

In the example of FIG. 8, this further hinge 62 renders the third portion 61 rotatable relative to the second portion 18, in the direction opposite to that in which the first portion 17 rotates relative to the selfsame second portion 18 about the hinge 19 first mentioned.

In the example of FIG. 12, the further hinge 62 renders the third portion 61 rotatable relative to the first portion 17, in the same direction as that in which the first portion 17 rotates relative to the second portion 18.

It will be seen that each hinge 19 and 62 consists, in practice, of two respective crease lines designed to facilitate the rotation of the boxes 22 one relative to another.

Figure 5:
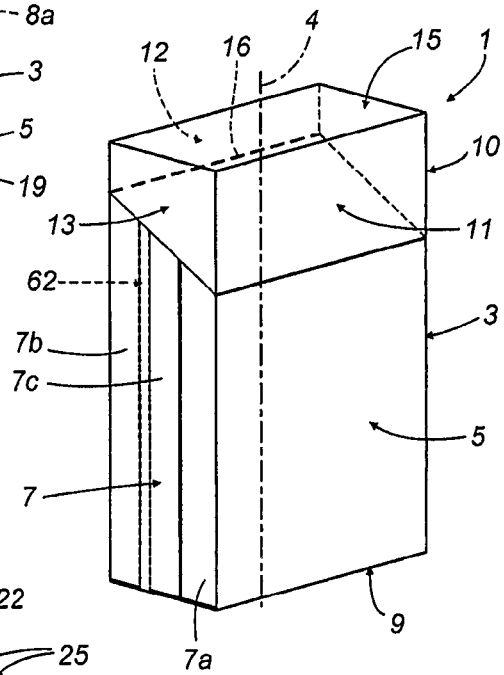
FIGS. 5, 6, 7 and 8 are perspective views showing a third embodiment of the packet according to the present invention, illustrated in four different configurations.
Figure 6:
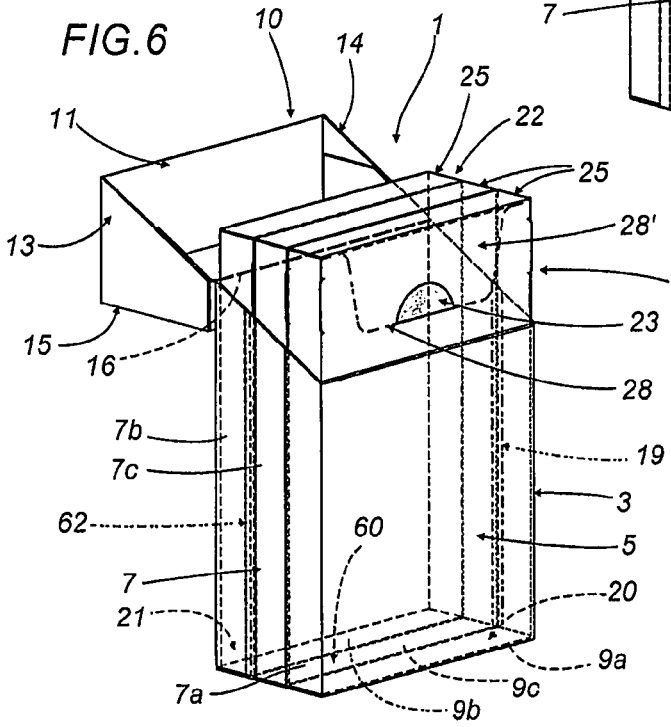
Figure 7:
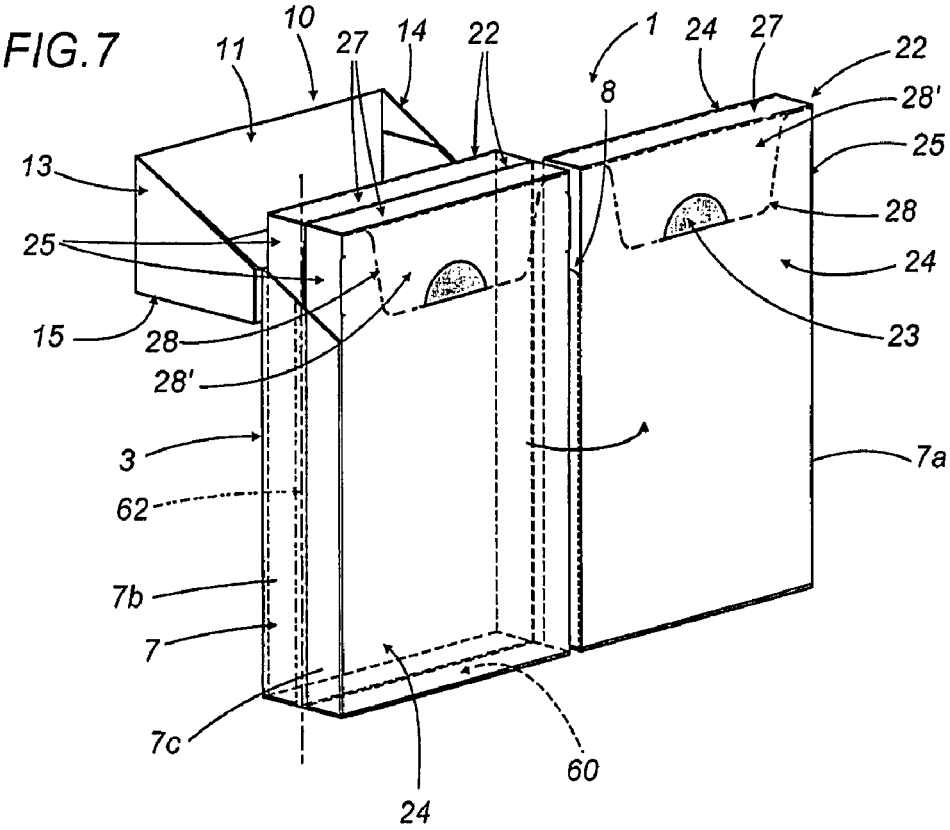
Figure 9:
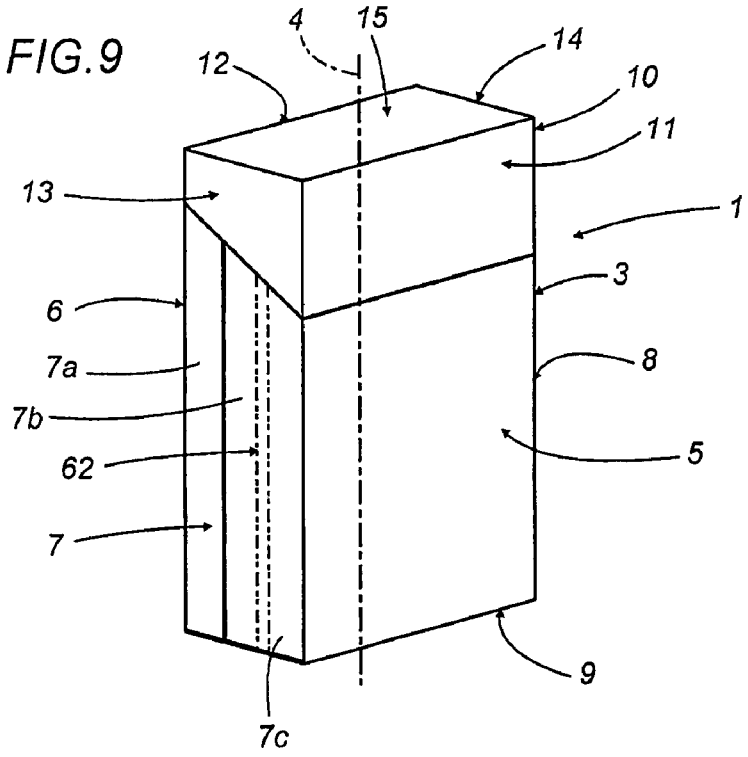
FIGS. 9 and 10 are perspective views showing a fourth embodiment of the packet according to the present invention.
Figure 10:
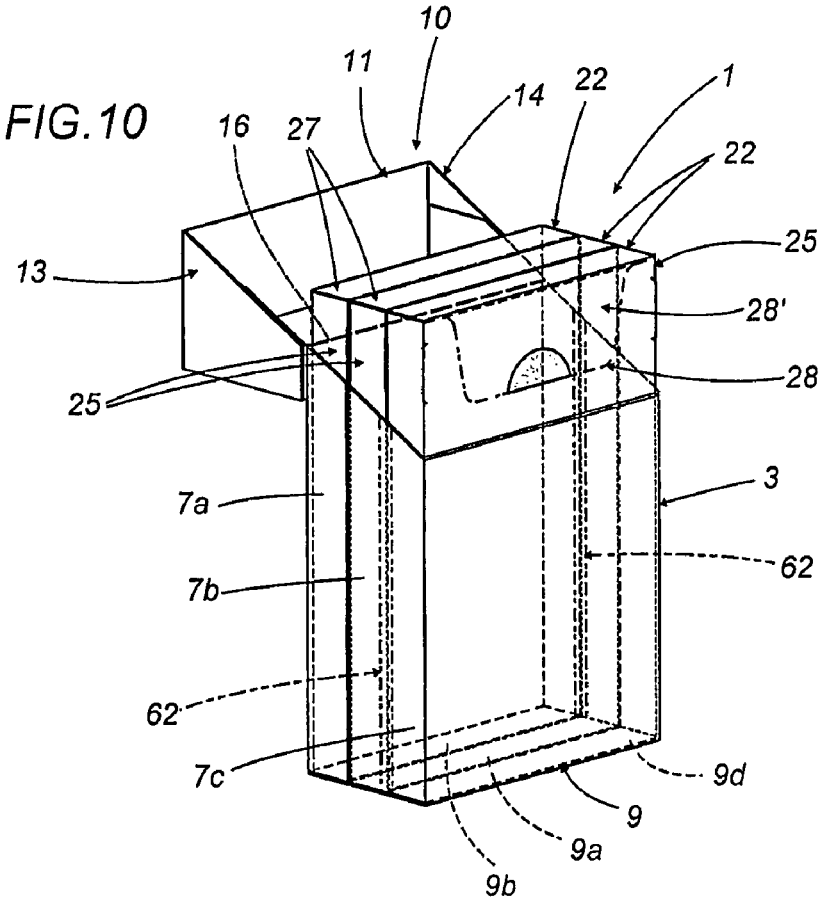
Figure 11:
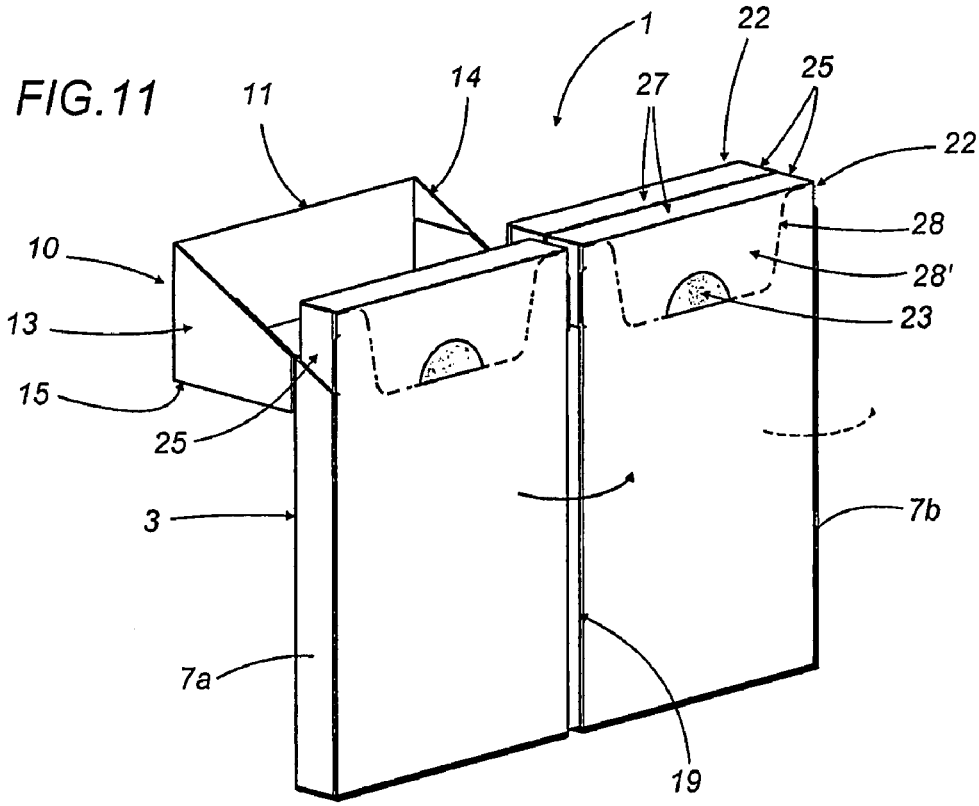
FIGS. 11 and 12 are perspective views showing the packet of FIG. 6 in two further configurations.
Figure 15:
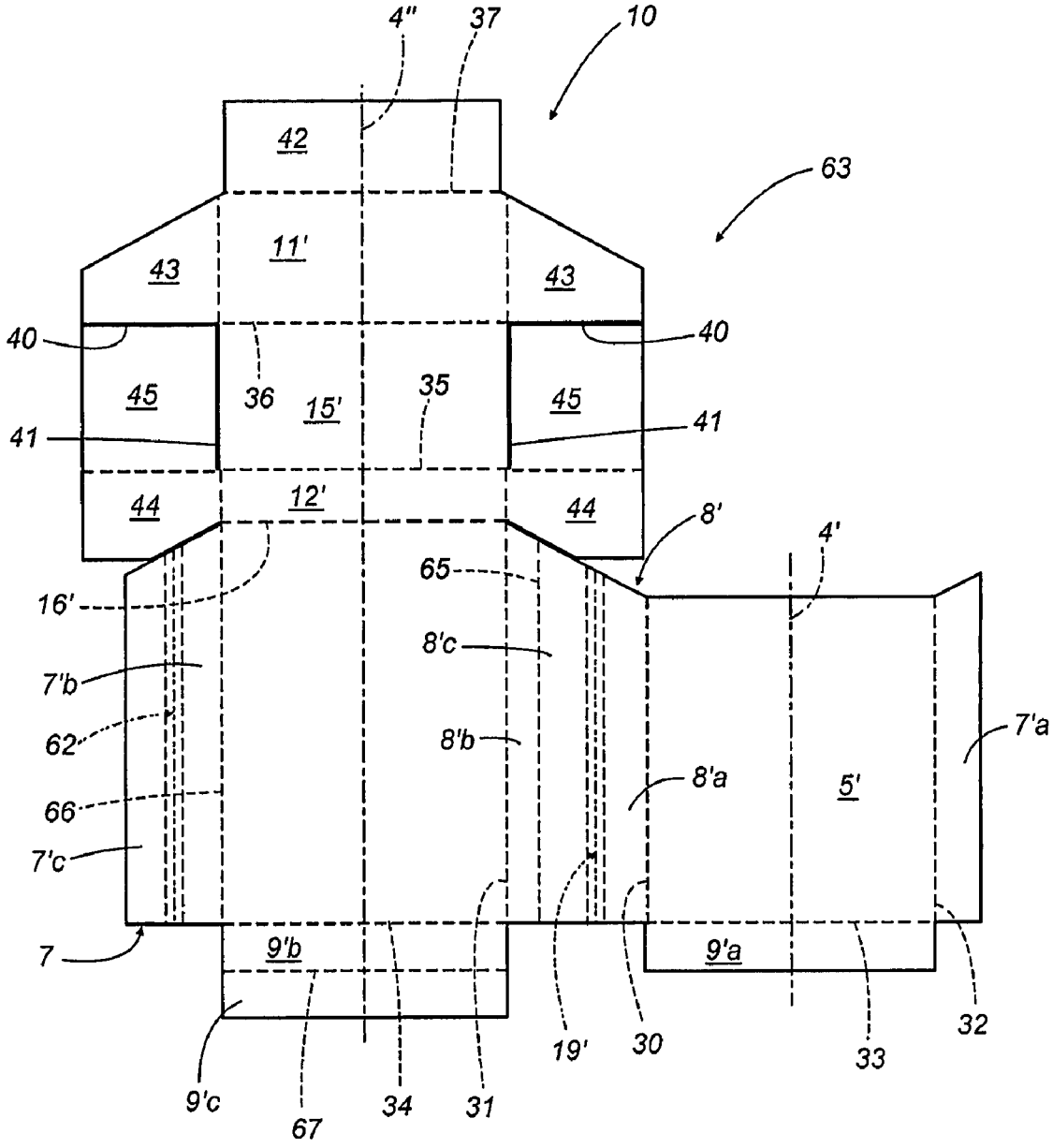
Figure 16:
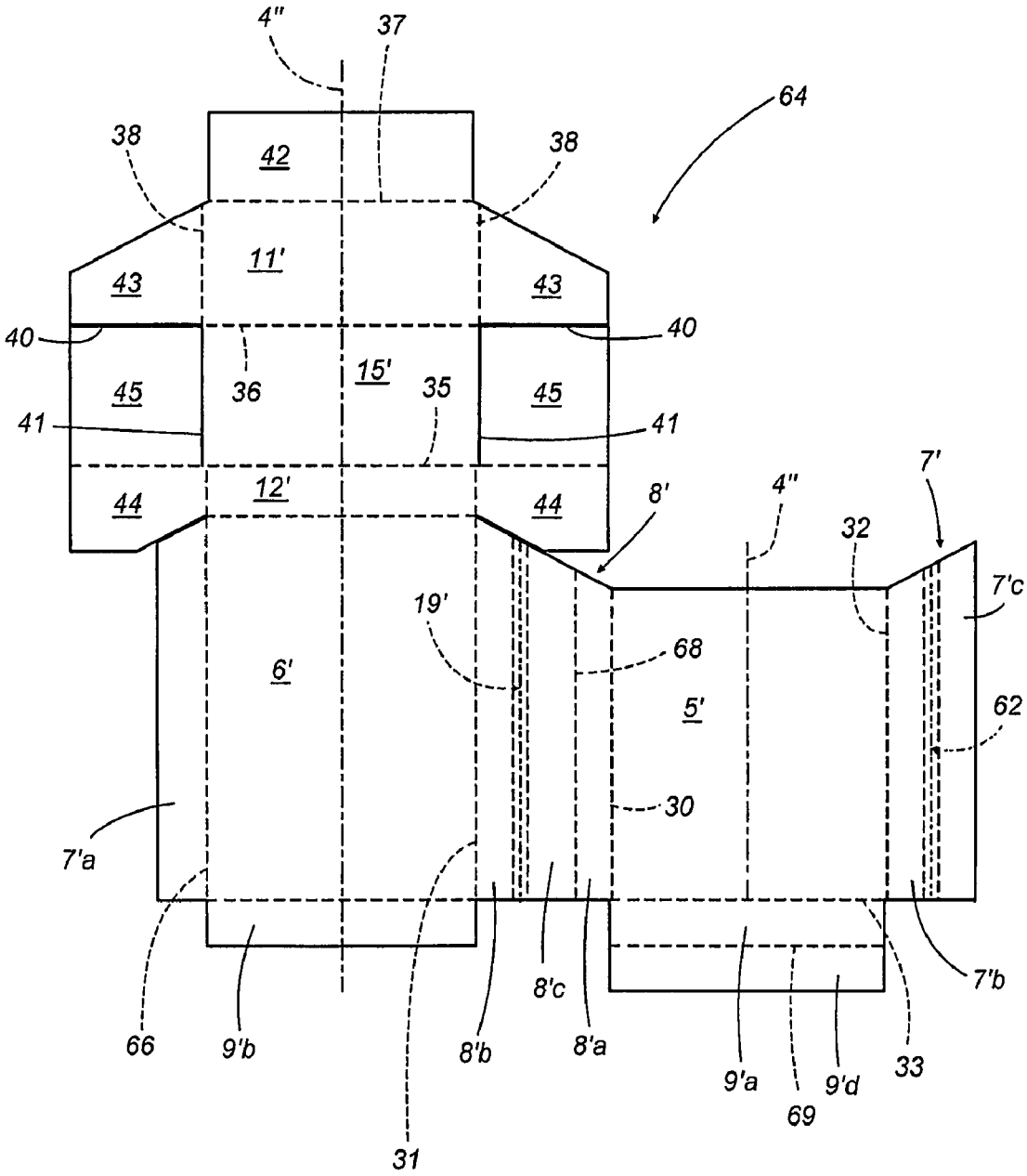

The outer wrappers 3 of the packets 1 shown in FIGS. 5 and 6 and in FIGS. 9 and 10 are fashioned by folding respective flat diecut blanks 63 and 64 as illustrated in FIGS. 15 and 16.

In the case of these blanks 63 and 64, the width of the third panel 8' and the fourth panel 7', hence the flanks 8 and 7 of the outer wrapper 3, is marginally greater than three times the depth of one box 22.

More exactly, the blank 63 of FIG. 15 differs from the blank 29 of FIG. 13 in that the connecting element afforded by the third panel 8' presents a succession of three longitudinal bands 8'*b*, 8'*c* and 8'*a* departing from the crease line denoted 31, divided by a first crease line 65 and a second crease line 19'. This second crease line 19' coincides with the hinge 19 between the first and second boxes 22.

The fourth panel 7' is joined to the second panel 6' along a crease line denoted 66 and affords the further hinge line 62 aforementioned, by which it is divided into two bands 7'*b* and 7'*c* respectively contiguous to and remote from the crease line 66, and along which the second and third boxes 22 are joined.

The first panel 5' presents a longitudinal end flap denoted 7'*a*, combining with the fourth panel 7' to form the second flank 7 of the outer wrapper 3.

Finally, the second panel 6' presents a further transverse end flap 9'*c* connected to the first end flap 9'*b* by way of a scored perforation line 67 and establishing the bottom of the third compartment 60, of which the aforementioned bands 7'*c* and 8'*c* provide the flanks.

The blank 64 of FIG. 16 differs from the blank 29 of FIG. 13 in that the connecting element afforded by the third panel 8' presents a succession of three longitudinal bands 8'*b*, 8'*c* and 8'*a* departing from the crease line denoted 31, divided by a first crease line 19' and a second crease line 68. The first crease line 19' coincides with the hinge 19 between the first and second boxes 22.

The fourth panel 7' is joined to the first panel 5' along the crease line denoted 32 and affords the hinge line 62 aforementioned, by which it is divided into two bands 7'*b* and 7'*c* respectively contiguous to and remote from the crease line 32, and along which the first and third boxes 22 are joined.

The second panel 6' presents a longitudinal end flap denoted 7'*a*, combining with the fourth panel 7' to form the second flank 7 of the outer wrapper 3.

Finally, the first panel 5' presents a further transverse end flap 9'*d* connected to the first end flap 9'*a* by way of a scored perforation line 69 and establishing the bottom of the third compartment 60, of which the aforementioned bands 7'*c* and 8'*c* provide the flanks.

Whilst the cigarette packet described thus far and illustrated in the accompanying drawings is of a rigid type with a hinged lid, in which the boxes 22 and the outer wrapper 3 present sharp corner edges, it will be clear that the teaching of the present invention is applicable to any given type of box and outer wrapper, which in alternative embodiments (not illustrated) might be fashioned with certain of the longitudinal and/or transverse corner edges rounded or bevelled. With reference to FIGS. 1, 4, 5 and 9, for example, the longitudinal corner edges might be rounded or bevelled rather than right-angled, or (adopting the shape of the cigarette packet disclosed in patent application EP-A1-0764595), the longer transverse corner edges (along which the bottom 9 and the larger side walls 5 and 6 are joined) might be rounded or bevelled rather than right-angled; alternatively, selected longitudinal corner edges and selected transverse corner edges might be rounded or bevelled rather than right-angled, in such a way as to incorporate both longitudinal and transverse corner edges with rounded or bevelled rather than right-angled profiles.

Finally, in a further embodiment of the invention not illustrated in the drawings, the packet 1 could present the appearance of the cigarette packet disclosed in patent application EP-A1-1066205; in this instance, each larger side wall 5 and 6 presents a substantially convex profile with a flat central portion and two precreased and curved lateral portions merged with the central portion and joined to the flanks 7 and 8 along respective sharp corner edges of obtusely angled profile.

In the examples of FIGS. 5 and 9, in particular, the above configuration could be adopted for one or more of the boxes 22 making up the packet 1.

The invention claimed is:

1. A packet for tobacco products, comprising:

an outer wrapper, substantially parallelepiped in appearance, referable to a longitudinal axis and having a larger front wall and a larger rear wall disposed parallel to the longitudinal axis, two smaller flank walls disposed at right angles to the larger walls, and a bottom end wall disposed transversely to the axis;

the outer wrapper being divided into at least two portions rotatably joined one to another by a longitudinal crease line extending along a connecting element coinciding with one of the two flank walls and acting as a longitudinal hinge;

each portion of the outer wrapper accommodating a rigid substantially parallelepiped box containing a group of tobacco products disposed parallel to the longitudinal axis, the group of tobacco products enveloped by an inner wrapper within the substantially parallelepiped box; each rigid parallelepiped box comprising a top end which includes a closure element having a detachable portion located at an end opposite from the bottom end wall of the outer wrapper; the detachable portion comprising a top end having a transverse wall opposite to a bottom end of the parallelepiped box, and two flaps adjoining the top end, each delimited by a relative outline scored on a respective wall of the parallelepiped box; and a hinged lid, connected to the outer wrapper along a relative transverse hinge line associated with the rear wall, and movable between a closed position encompassing corresponding ends of the parallelepiped boxes contained inside the outer wrapper and in which the parallelepiped boxes are prevented from rotating one relative to the other, and an open position free from the corresponding ends of the parallelepiped boxes in which the parallelepiped boxes are rotatable one relative to another.

2. A packet as in claim 1, comprising an outer wrapper divided into two portions establishing respective first and second compartments proportioned to accommodate respective first and second parallelepiped boxes joined one to another by way of the connecting element, wherein the first and second compartments are delimited by the flank wall providing the connecting element, in combination respectively with the front wall, a first portion of the bottom and a first portion of a flank wall opposite to the flank wall providing the connecting element, and with the rear wall, a second portion of the bottom and a second portion of the flank wall opposite to the flank wall providing the connecting element.

3. A packet as in claim 1, comprising an outer wrapper divided into three portions, of which a first and a second portion establish a first and second compartment accommodating a first and a second parallelepiped box, and the third portion establishes a third compartment interposed between the first and second compartment and accommodating a third parallelepiped box, wherein the first and second portions and the second and third portions are joined by way of respective hinge lines extending along opposite flanks of the outer wrapper.

4. A packet as in claim 3, wherein the first compartment is delimited by a first flank providing the connecting element, in combination with the front wall, a first portion of the bottom and a first portion of a flank opposite to the flank providing the connecting element, whilst the second compartment is delimited by the flank wall providing the connecting element, in combination with the rear wall, a second portion of the bottom and a second portion of the flank opposite to the flank providing the connecting element.

5. A packet as in claim 4, wherein the third compartment is connected to the second compartment by way of the flank opposite to the flank providing the connecting element between the second and first compartments.

6. A packet as in claim 4, wherein the third compartment is connected to the first compartment by way of the flank opposite to the flank providing the connecting element between the second and first compartments.

7. A packet as in claim 2, wherein the outer wrapper is furnished, along the flank wall opposite to the flank wall connecting the second compartment and the first compartment, with a breakable seal uniting portions of the flank wall; each parallelepiped box comprising two flanks with which the uniting portions of the flank wall, opposite to the flank wall providing the connecting element, are breasted.

8. A packet as in claim 7, wherein the breakable seal includes a line scored longitudinally along the flank.

9. A packet as in claim 7, wherein the breakable seal includes two lines scored longitudinally along the flank and delimiting a removable strip.

10. A packet as in claim 7, wherein the breakable seal includes a removable adhesive element.

11. A packet as in claim 1, wherein the outer wrapper is formed from a flat blank of packaging material comprising: a first panel and a second panel both of substantially rectangular appearance, referable to longitudinal axes parallel one to another and to the longitudinal axis of the packet, coinciding respectively with the front wall and the rear wall; a third panel joined to the first and second panels by way of longitudinal crease lines and coinciding with a first flank of the outer wrapper; a fourth panel associated with the first panel or the second panel on the side opposite to the third panel, joined by way of a respective longitudinal crease line and coinciding with the second flank of the outer wrapper; at least one transverse end flap, joined along a respective transverse crease line to the first panel and at least one transverse end flap joined along a respective transverse crease line to the second panel, combining to form the bottom end wall of the outer wrapper; and a fifth panel, joined to the second panel along a transverse crease line coinciding with the transverse hinge of the lid, comprising a plurality of panels and flaps separated by transverse and longitudinal crease lines and by slit cuts and combining to form the lid.

12. A packet as in claim 11, wherein each of the parallelepiped boxes is formed from a flat blank of substantially rectangular outline referable to a predominating longitudinal axis, and having a plurality of transverse crease lines and two longitudinal crease lines combining to delimit: a first and a second panel coinciding with the larger side walls of the parallelepiped box; a band interposed between the first and second panels and coinciding with the bottom end of the parallelepiped box; two end flaps combining to form the top end; two longitudinal flaps joined along the longitudinal crease lines to each panel and combining in pairs to form the flanks of the parallelepiped box; and a pair of closure tongues fastenable to the bottom end of the parallelepiped box, delimited by corresponding transverse and longitudinal L-shaped slit cuts located at opposite ends of the intermediate band.

13. A packet as in claim 12, wherein the flat blank comprises opposite ends having two detachable portions arranged symmetrically on either side of a transverse axis, generated by respective scored U-shaped outlines, combining one with another and with the end flaps to form the closure element.

14. A packet as in claim 2, wherein the outer wrapper is formed from a flat blank of packaging material comprising: a first panel and a second panel both of substantially rectangular appearance, referable to longitudinal axes parallel one to another and to the longitudinal axis of the packet, coinciding respectively with the front wall and the rear wall; a third panel joined to the first and second panels by way of longitudinal crease lines and coinciding with a first flank of the outer wrapper; a fourth panel associated with the first panel or the second panel on the side opposite to the third panel, joined by way of a respective longitudinal crease line and coinciding with the second flank of the outer wrapper; at least one transverse end flap joined along a respective transverse crease line to the first panel and at least one transverse end flap joined along a respective transverse crease line to the second panel, combining to form the bottom end wall of the outer wrapper; and a fifth panel, joined to the second panel along a transverse crease line coinciding with the transverse hinge of the lid, comprising a plurality of panels and flaps separated by transverse and longitudinal crease lines and by slit cuts and combining to form the lid, and wherein the third panel provides the connecting element and includes at least one longitudinal crease line coinciding with the longitudinal hinge on which the two parallelepiped boxes are rendered rotatable one relative to another.

15. A packet as in claim 14, wherein the fourth panel includes a removable strip providing the breakable seal.

16. A packet as in claim 5, wherein the outer wrapper is formed from a flat blank of packaging material comprising: a first panel and a second panel both of substantially rectangular appearance, referable to longitudinal axes parallel one to another and to the longitudinal axis of the packet, coinciding respectively with the front wall and the rear wall; a third panel joined to the first and second panels by way of longitudinal crease lines and coinciding with a first flank of the outer wrapper; a fourth panel associated with the first panel or the second panel on the side opposite to the third panel, joined by way of a respective longitudinal crease line and coinciding with the second flank of the outer wrapper; at least one transverse end flap joined along a respective transverse crease line to the first panel and at least one transverse end flap joined along a respective transverse crease line to the second panel, combining to form the bottom end wall of the outer wrapper; and a fifth panel, joined to the second panel along a transverse crease line coinciding with the transverse hinge of the lid, comprising a plurality of panels and flaps separated by transverse and longitudinal crease lines and by slit cuts and combining to form the lid, and formed from a blank of which the third panel provides a connecting element having a transverse dimension marginally greater than three times the depth of a single parallelepiped box and appearing as a succession of three longitudinal bands departing from the longitudinal crease line by which it is joined to the second panel, divided by a first crease line and at least one second crease line, the second crease line coinciding with the hinge on which the first and second parallelepiped boxes are rendered rotatable one relative to another, wherein the fourth panel is joined to the second panel along a respective longitudinal crease line and affords the hinge line on which the second and third parallelepiped boxes are rendered rotatable one relative to another, the first panel has a longitudinal end flap combining with the fourth panel to form the second flank of the outer wrapper, and the second panel has a further transverse end flap joined to the first end flap along a scored transverse perforation line and coinciding with a bottom of the third compartment.

17. A packet as in claim 6, wherein the outer wrapper is formed from a flat blank of packaging material comprising: a first panel and a second panel both of substantially rectangular appearance, referable to longitudinal axes parallel one to another and to the longitudinal axis of the packet, coinciding respectively with the front wall and the rear wall; a third panel joined to the first and second panels by way of longitudinal crease lines and coinciding with a first flank of the outer wrapper; a fourth panel associated with the first panel or the second panel on the side opposite to the third panel, joined by way of a respective longitudinal crease line and coinciding with the second flank of the outer wrapper; at least one transverse end flap joined along a respective transverse crease line to the first panel and at least one transverse end flap joined along a respective transverse crease line to the second panel, combining to form the bottom end wall of the outer wrapper; and a fifth panel, joined to the second panel along a transverse crease line coinciding with the transverse hinge of the lid, comprising a plurality of panels and flaps separated by transverse and longitudinal crease lines and by slit cuts and combining to form the lid, and formed from a blank of which the third panel provides a connecting element having a transverse dimension marginally greater than three times a depth of a single parallelepiped box and appearing as a succession of three longitudinal bands departing from the longitudinal crease line by which it is joined to the second panel, divided by at least one first crease line and a second crease line, the first crease line coinciding with the hinge on which the first and second parallelepiped boxes are rendered rotatable one relative to another, wherein the fourth panel is joined to the first panel along the respective longitudinal crease line and affords the hinge line on which the second and third parallelepiped boxes are rendered rotatable one relative to another, the second panel has a longitudinal end flap combining with the fourth panel to form the second flank of the outer wrapper, and the first panel has a further transverse end flap joined to the first end flap along a scored transverse perforation line and coinciding with a bottom of the third compartment.

* * * * *